US005630406A

United States Patent [19]

Dumont

[11] Patent Number: 5,630,406

[45] Date of Patent: May 20, 1997

[54] PAINT-BALL GUN

[76] Inventor: Maurice Dumont, 26½ Broad St., Binghamton, N.Y. 13904

[21] Appl. No.: 419,494

[22] Filed: Apr. 10, 1995

[51] Int. Cl.[6] ..... F41B 11/00

[52] U.S. Cl. ..... 124/56; 124/73; 42/75.02

[58] Field of Search ..... 124/56, 73, 74, 124/76; 403/325, 321, 322, 324; 411/52, 348; 42/75.02, 75.03

[56] References Cited

U.S. PATENT DOCUMENTS

| | | | |
|---|---|---|---|
| 2,345,127 | 3/1944 | Kehne | 42/75.02 |
| 2,736,119 | 2/1956 | Clarkson et al. | 42/75.02 |
| 2,817,174 | 12/1957 | Liedke | 42/75.02 |
| 3,171,182 | 3/1965 | Danehy | 411/552 |
| 3,250,559 | 5/1966 | Sommerfeld | 411/552 X |
| 4,648,191 | 3/1987 | Goff et al. | 42/75.02 |
| 4,936,282 | 6/1990 | Dobbins et al. | 124/74 |
| 5,078,118 | 1/1992 | Perrone | 124/73 X |
| 5,280,778 | 1/1994 | Kostiopoulos | 124/73 |
| 5,333,515 | 8/1994 | Schneider | 403/324 X |
| 5,339,791 | 8/1994 | Sullivan | 124/73 |

*Primary Examiner*—Randolph A. Reese
*Assistant Examiner*—Thomas A. Beach
*Attorney, Agent, or Firm*—Salzman & Levy

[57] ABSTRACT

The present invention features an improved paint-ball pistol, which has two detent-pin mechanisms, one of which firmly affixes the front receiver of the gun to the trigger housing, and one of which that firmly affixes the barrel to the front receiver. In the event that either the front receiver must be detached from the trigger housing or the barrel from the front receiver (as in those instances when a paint-ball capsule ruptures therein), the detent-pin mechanism allows for immediate and almost instantaneous removal thereof. The detent-pin mechanisms each have a knob that is movable between a locked and a retracted position, and a screw that is affixed to the knob. The screws extend from the knobs through the front of the trigger housing and through the forward portion of the front receiver. The ends of the screws extend beyond the inner trigger housing surface and beyond the inner front receiver surface and into the holes in the outer surfaces of the front receiver and the barrel of the gun. About each of the screws is a coil spring, which is captured at a top portion of the screw by a jam nut. The outward, pulling movement of the knob removes the screw shaft from the hole in either the front receiver or the barrel. In this retracted position, the front receiver or the barrel is freed from its original position, and can be slidably removed. The operator then has both hands free to disengage either piece. The part can then be slid back, and the knob quarter-twisted and returned to its initial, locked position. The detent-pin mechanism of this invention makes the removal of both front receiver and barrel and their reinsertion a quick procedure, one that is achieved by a simple pull and twist of a knob.

6 Claims, 2 Drawing Sheets

PAINT-BALL GUN

FIELD OF THE INVENTION

The present invention pertains to paint-ball guns and, more particularly, to a paint-ball pistol having a front receiver-barrel combination that is easily detachable, both from each other and from the main body of the gun. The front receiver and the barrel lock in place via two spring-biased, detent-pin mechanisms; one locks the barrel to the front receiver, and the other locks the front receiver to the trigger housing.

BACKGROUND OF THE INVENTION

Over the past fourteen years, a new recreational pastime of engaging in paint-ball games has emerged, a pastime in which capsules containing water-soluble paint are fired from pistol-type weapons by two separate teams. (The teams try to capture a flag and thus eliminate their opponents.) A paint-ball is comprised of a frangible gelatin capsule that encases a small quantity of paint. Projected through the air by carbon dioxide, nitrogen or compressed air, the balls disperse the paint contained in the gelatin encasement when hitting their targets. In fact, the paint splatters upon impact, thus marking that particular player out of the game.

The pistols used to fire the paint-balls are relatively uncomplicated gas-powered guns, resembling pellet or BB guns. A paint-ball gun consists of a trigger housing upon which are mounted a back receiver and a front receiver. The back receiver houses a hammer, which is initially pushed against a spring, causing the spring to contract. Upon release, the hammer moves forward through the back receiver, due to the uncoiling spring force. The hammer is released for forward movement by the action of a sear, that is actuated by a trigger mechanism. The sear initially holds the hammer in place against the contracted spring. Upon release of the hammer, the sear moves forward, creating two different reactions. The sear pushes a rod connected to the hammer and the front bolt forward, thus pushing a paint-ball from the front receiver feed-port into the barrel. As the ball is being chambered in the barrel, the hammer strikes the valve assembly, which releases gas in two different directions, forward and backward. It is the forward blast of gas that provides the kinetic impetus that forces a paint-ball through the barrel and into the air.

One of the major problems with the paint-ball pistols is the tendency of the gelatin capsules to break or rupture, either within the front receiver (where the front bolt pushes the paint-ball) or the barrel of the gun. This often happens due to the fact that the gelatin capsules are especially designed to be frangible and to break on impact. Therefore, when actuating the hammer and releasing the gas charge, it is not unusual to impart too much force to the capsule. In cases where the capsules have broken, the ability to propel or project further capsules is impaired. Wherever the capsule break occurs, that area must be cleaned of paint-ball debris, prior to resuming paint-ball activity. The ruptured paint-ball leaves a particularly gooey and unmanageable mess, thereby necessitating the removal and cleaning of the front receiver or barrel proper.

Present paint-ball pistols have front receivers and barrels that do not detach easily, either from each other or from the trigger housing. As a result, cleaning a paint-ball pistol is generally tedious and especially inconvenient during actual play, hampering a player's ability to function or help his or her team. This impediment thus slows down a player's paint-ball shooting, causing a game to become less enjoyable and affecting not only his continued play, but also that of his team. This is an especially critical problem for tournament players vying for financial reward.

There has, therefore, arisen a need to provide a paint-ball pistol with a front receiver and a barrel that can be easily and quickly removed from the trigger housing of the gun; cleaned; and then easily reattached.

The need has been long felt, because many paint-ball pistol designs have tried to provide this improvement without much success. Most such guns utilize set screws to hold the trigger housing to the front receiver and a thumb screw to affix the barrel to the front receiver. While not a formidable task, the turning of screws is, however, a time-consuming procedure; it often requires tools, which are not permitted on the playing field. The misplacement or dropping of the tear-down screws during play makes the paint-ball gun inoperable. The need to spend several minutes to remove, clean and then reattach the front receiver or the barrel severely limits present-day enjoyment of the sport and greatly affects the performance of an individual player and her team.

The present inventor has developed a simple, reliable and convenient means by which the front receiver or the barrel of a paint-ball gun can be removed, cleaned and then reattached quickly, without the need for tools and without a player having to face the possibility of losing the screws during the excitement of the game.

The current invention uses a spring-loaded detent mechanism to anchor the front receiver to the trigger housing of the pistol, and a duplicate spring-loaded detent mechanism to anchor the barrel to the front receiver. The detent mechanism requires a simple pull of a knob against a biasing spring force to withdraw a locking pin from a hole in the front receiver or the barrel. Once the locking pin is removed, either the front receiver or the barrel can be easily slid from its original position (e.g., to be cleaned). The knob is given a quarter-twist after it is pulled, so that it can rest upon an anchoring abutment. The anchoring abutment allows the pin to remain withdrawn, freeing both hands to disengage either the front receiver from the trigger housing or the barrel from the front receiver.

SUMMARY OF THE INVENTION

In accordance with the present invention, there is provided an improved paint-ball pistol. The pistol features two detent-pin mechanisms, one of which firmly affixes the front receiver of the gun to the trigger housing and one of which firmly affixes the barrel to the front receiver. In the event that either the front receiver must be detached from the trigger housing or the barrel from the front receiver (as in those instances when a paint-ball capsule ruptures therein), the detent-pin mechanism allows for immediate and almost instantaneous removal thereof. The detent-pin mechanism comprises a knob that is movable between a locked and a retracted position. The mechanism comprises a shaft that is affixed to the knob. With regard to the front receiver, the shaft extends from the knob through the body of the trigger housing of the pistol. The end of the shaft extends beyond the inner trigger housing surface, and projects into a hole disposed in the outer surface of the front receiver. With regard to the barrel, the shaft extends from the knob through the body of the front receiver of the pistol. The end of the shaft extends beyond the inner front receiver surface, and projects into a hole disposed in the outer surface of the barrel.

A coil spring is disposed about the shaft within both a hollow bore of the trigger housing and a hollow bore of the front receiver; it is captured at a top portion of the shaft by a washer plate. The knob is pulled outwardly away from the locked position, against the biasing of the coil spring, which is made to compress because of the washer plate. The outward movement of the knob removes the shaft from the hole located in either the front receiver or the barrel. In this retracted position, the front receiver is freed from the trigger housing, and the barrel is freed from the front receiver; the front receiver and/or the barrel can then be slidably removed therefrom. In the locked position, the knob has a slot that rests upon a lateral extension finger disposed on a pedestal of the trigger housing (or the front receiver). When the knob is pulled outwardly, the slot clears the lateral extension finger and is free to rotate. A quarter-twist of the knob will then temporarily affix the knob upon the pedestal in the retracted position, due to the spring biasing. In the retracted knob position, the operator has both hands free to disengage either the front receiver from the trigger housing or the barrel from the front receiver of the gun.

After either piece has been removed, it can be slid back into its original position, with the knob being quarter-twisted and returned to its initial, locked position. The end of the extension shaft will then slip into the detent hole in either the front receiver or the barrel, as before, thus securely locking the piece back into place. The detent-pin mechanism of this invention makes the removal of both front receiver and barrel and their reinsertion a quick procedure, one that is achieved by a simple pull and twist of a knob.

BRIEF DESCRIPTION OF THE DRAWINGS

A complete understanding of the present invention may be obtained by reference to the accompanying drawings, when considered in conjunction with the subsequent detailed description, in which.

For the sake of brevity and clarity, like components and elements will bear the same designations and numerals throughout the FIGURES.

DESCRIPTION OF THE PREFERRED EMBODIMENT

Generally speaking, the invention features a pistol used for paint-ball shooting, in which the front receiver section of the gun is easily assembled upon and removed from the trigger housing portion thereof, and the barrel section of the gun is easily assembled upon and removed from the front receiver portion thereof. Conventionally, the front receiver section is secured to the trigger housing by means of set screws and the barrel section secured to the front receiver by a thumb screw. It has been found that such securement measures are not facile enough to provide for the ease of assembly or removal during a paint-ball game. In order to provide a quick, convenient method of cleaning either the front receiver or the barrel, this invention provides a new detent-pin mechanism that allows both the front receiver and the barrel to be easily removed. This removal is accomplished by retracting a detent pin attached to a holding knob, and then rotating the holding knob with a quarter-twist so that the knob is temporarily secured in the detent-retracted position. Both hands of the user are then free to slide either the front receiver from the trigger housing or the barrel from the front receiver, clean it, and return same to its original position on the pistol.

Figure 1:
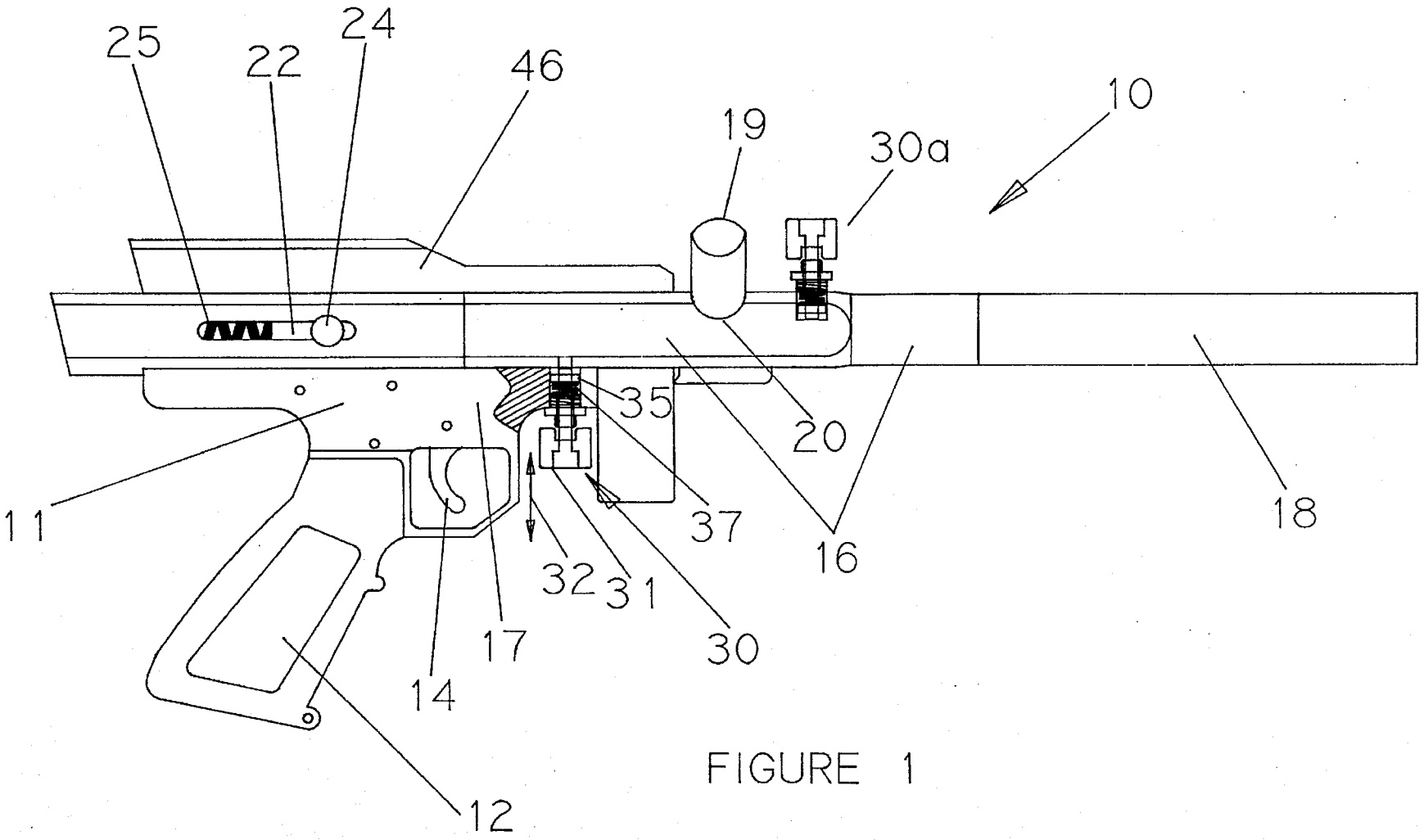
FIG. 1 illustrates an in situ view of the detent-pin mechanism of this invention as displayed in relation to the paint-ball gun shown in perspective view.

Now referring to FIG. 1, a perspective view of the inventor's paint-ball pistol 10 is illustrated. The pistol 10 comprises a trigger housing 11 featuring a handle 12 and a trigger 14. A front receiver 16 is attached to the front portion 17 of the trigger housing 11 by means of a biased, retractable detent-pin mechanism 30. A barrel 18 fits within the front receiver 16, as shown, and is held in place by means of an identical, biased, retractable, detent-pin mechanism 30*a*. The front receiver 16 carries a hollow tube feed-port 19, bolted thereto at demarcation line 20. The hollow tube feed-port 19 allows a bulk feeder (not shown) to be attached that carries a number of paint-ball capsules (not shown), which feed into the interior of the front receiver 16 when a hammer 22 is drawn back by a pull-knob 24 against coil spring 25.

Coil spring 25, that biases the action of the hammer 22, forces the hammer 22 against a gas valve (not shown), which releases a charge of gas that provides a steady, outward thrust of the gelatin, paint-ball capsule. The hammer 22 is actuated by the trigger 14, which activates an internal sear (not shown) that normally holds the hammer 22 in its retracted position.

The front receiver 16 slides onto the front portion 17 of the trigger housing 11 between the trigger housing 11 and a sight rail 46, and is securely affixed in position by means of a detent-pin mechanism 30. The detent-pin mechanism 30 comprises a retractor knob 31, which is movable up and down (arrows 32), as illustrated.

The barrel 18 slides into the front receiver 16, and is securely affixed in position by means of detent-pin mechanism 30*a*, a mechanism that is identical to detent-pin 30.

Figure 2:
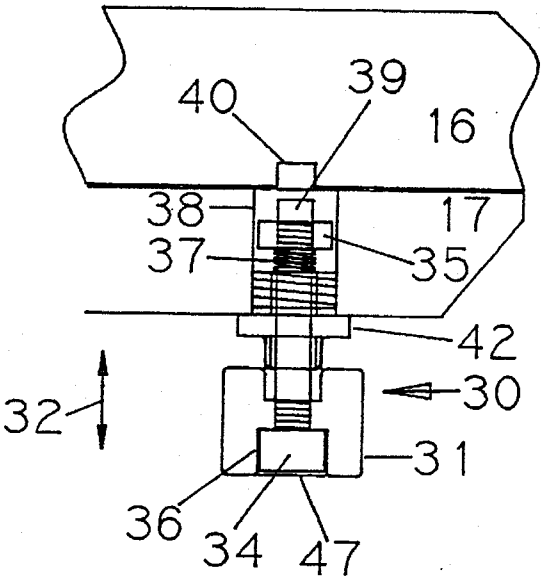
FIG. 2 depicts an enlarged sectional view of the detent-pin mechanism shown in FIG. 1, illustrated in the retracted position, with a superimposed, phantom view thereof in the locked position.

Referring to FIG. 2, an enlarged sectional view of the detent-pin mechanism 30 of this invention is shown in the retracted position. A phantom view is superimposed thereupon of the detent-pin mechanism 30 as it is depicted in a locked position. As aforementioned, the detent-pin mechanism 30 features a retractor knob 31, which comprises an internal screw 34, extending upwardly therefrom. The internal screw 34 is threaded into retractor knob 31. At the upper end of the screw 34, a flat, jam nut 35 is attached, approximately ⅛ of an inch from the end. The threads of the last ⅛ of an inch of the screw 34 are removed. The screw head 47 fits in well 36 of knob 31, allowing the knob 31 to withdraw screw 34 when the knob 31 is pulled outwardly against bias spring 37. The jam nut 35 captures the bias spring 37 that is disposed in a bore hole 38 (covering both jam nut 35 and spring 37, and formed in a manner well-known in the art) in the front portion 17 of the trigger housing 11. When the retractor knob 31 is pulled outwardly (downwardly, arrow 32) against the biasing of spring 37, it causes the upper end 39 of the screw 34 to withdraw from hole 40 disposed in the rear of the front receiver 16. This frees the front receiver 16 from being locked to the trigger housing 11. The needed part is now capable of being slid out of its original position.

Figure 3:
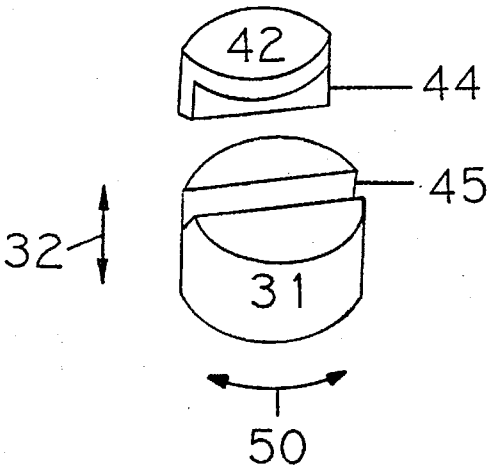
FIG. 3 shows a partial, perspective view of the knob-pedestal portion of the detent-pin mechanism illustrated in FIGS. 1 and 2.
Figure 4:
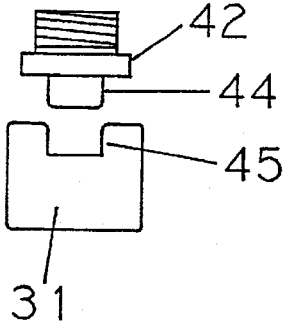
FIG. 4 shows a side view of the knob and pedestal, depicted in FIG. 3, in their fully retracted position.

The retractor knob 31 can be temporarily held in the retracted position by means of a pedestal 42 that is attached to the front portion 17 of the trigger housing 11. This is better illustrated and explained via FIGS. 3 and 4. The knob 31 has an internal groove or slot 45, as illustrated in FIGS. 3 and 4. The slot 45 nests upon an elongated tongue 44 that is disposed on the pedestal 42. When the knob 31 is retracted outwardly (as shown by arrow 32), and the groove 45 clears the tongue 44, the knob 31 can be given a quarter-twist turn (as shown by arrows 50). When this is done, and the knob 31 is released against the bias force of internal spring 37, the knob 31 will come to the temporary locking position, illustrated in FIG. 4. In this position, the knob 31 rests upon the tongue 44 of pedestal 42, as shown. In this temporary position, both of the user's hands are free to remove and clean the front receiver 16. When the front receiver 16 has been cleaned, it can be slid back into its original position on the trigger housing 11, and the retracting procedure of the detent-pin mechanism 30 is reversed, thus locking the part securely back in place.

The structure and operation to secure and remove the barrel 18 from the front receiver 16 is equivalent to that discussed hereinabove. Detent-pin mechanism 30*a* is identical to mechanism 30 and has identical properties thereto.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A paint-ball pistol having a removable barrel that is held to the front receiver of the pistol by a first, biased, detent-pin mechanism which firmly affixes said barrel of said paint-ball pistol to said front receiver in a first locking position, and upon actuation thereof, releases a locking detent pin, so that said barrel can be slid from said front receiver, and said front receiver being removable and held to the trigger housing of the pistol by a second, biased, detent-pin mechanism which firmly affixes said front receiver of said paint-ball pistol to said trigger housing in a first locking position, and upon actuation thereof, releases a locking detent pin, so that said front receiver can be slid from said trigger housing, said first, biased, detent-pin mechanism comprising:

a front receiver supporting said barrel of said pistol;

a first knob that is movable between a locked and a retracted position, said first knob being carried upon said front receiver of said pistol;

a first shaft extending from, and affixed to, said first knob, said first shaft extending through and beyond the front receiver to engage with and lock said barrel to said front receiver in said locked position, said barrel being freed from said front receiver when said first shaft is withdrawn by said first knob to said retracted position; and first biasing means supported by said front receiver for biasing said first knob against movement from said locked position to said retracted position;

said second, biased, detent-pin mechanism comprising:

a trigger housing supporting said front receiver of said pistol;

a second knob that is movable between a locked and a retracted position, said second knob being carried upon said trigger housing of said pistol;

a second shaft extending from, and affixed to, said second knob, said second shaft extending through and beyond the trigger housing to engage with and lock said front receiver in said locked position, said front receiver being freed from said trigger housing when said second shaft is withdrawn by said second knob to said retracted position; and second biasing means supported by said trigger housing for biasing said second knob against movement from said locked position to said retracted position; and two pedestals respectively carried by said front receiver and said trigger housing, each of said pedestals having a tongue, and each one of said knobs comprising means defining a groove, and further wherein each of said tongues nest within each of said grooves when said respective knobs are in said locked position.

2. The paint-ball pistol in accordance with claim 1, further comprising respective means for rotating each of said knobs with respect to each respective pedestal, whereby when each of said knobs receives a half-twist turn, said knob will be supported upon the tongue of said pedestal by a biasing force provided by said biasing means.

3. A paint-ball pistol having a removable front receiver that is held to the trigger housing of the pistol by a biased, detent-pin mechanism which firmly affixes said front receiver of said paint-ball pistol to said trigger housing in a first locking position, and upon actuation thereof, releases a locking detent pin, so that said front receiver can be slid from said trigger housing, said detent-pin mechanism comprising:

a trigger housing supporting said front receiver of said pistol;

a knob that is movable between a locked and a retracted position, said knob being carried upon said trigger housing of said pistol;

a screw extending from, and affixed to said knob, said screw extending through and beyond the trigger housing to engage with and lock said front receiver to said trigger housing in said locked position, said front receiver being freed from said trigger housing when said screw is withdrawn by said knob to said retracted position;

biasing means supported by said trigger housing for biasing said knob against movement from said locked position to said retracted position; and a pedestal carried by said trigger housing, said pedestal having a tongue, and said knob comprising means defining a groove, and further wherein said tongue nests within said groove when said knob is in said locked position.

4. The paint-ball pistol in accordance with claim 3, further comprising means for rotating said knob with respect to said pedestal, whereby when said knob receives a quarter-twist turn, said knob will be supported upon the tongue of said pedestal by a biasing force provided by said biasing means.

5. A paint-ball pistol having a removable barrel that is held to the front receiver of the pistol by a biased, detent-pin mechanism which firmly affixes said barrel of said paint-ball pistol to said front receiver in a first locking position, and upon actuation thereof, releases a locking detent pin, so that said barrel can be slid from said front receiver, said biased, detent-pin mechanism comprising:

a front receiver supporting said barrel of said pistol;

a knob that is movable between a locked and a retracted position, said knob being carried upon said front receiver of said pistol;

a screw extending from and affixed to said knob, said screw extending through and beyond the front receiver to engage with and lock said barrel to said front receiver in said locked position, said barrel being freed from said front receiver when said screw is withdrawn by said knob to said retracted position;

biasing means supported by said front receiver for biasing said knob against movement from said locked position to said retracted position; and a pedestal carried by said front receiver, said pedestal having a tongue, and said knob comprising means defining a groove, and further wherein said tongue nests within said groove when said knob is in said locked position.

6. The paint-ball pistol in accordance with claim 5, further comprising means for rotating said knob with respect to said pedestal, whereby when said knob receives a quarter-twist turn, said knob will be supported upon the tongue of said pedestal by a biasing force provided by said biasing means.

* * * * *